United States Patent [19]

Odds

[11] 4,209,952

[45] Jul. 1, 1980

[54] UNDERWATER JET BLASTING APPARATUS

[75] Inventor: David J. H. Odds, Horley, England

[73] Assignee: F. A. Hughes and Company Limited, Epsom, England

[21] Appl. No.: 940,666

[22] Filed: Sep. 8, 1978

[30] Foreign Application Priority Data

Sep. 12, 1977 [GB] United Kingdom ..... 37975/77

[51] Int. Cl.[2] ..... B24C 7/00; B24C 5/02

[52] U.S. Cl. ..... 51/415; 51/427; 51/438

[58] Field of Search ..... 51/427, 436, 438, 415; 114/222

[56] References Cited

U.S. PATENT DOCUMENTS

| | | | |
|---|---|---|---|
| 2,729,917 | 1/1956 | Gregory | 51/427 |
| 3,070,924 | 1/1963 | Hastrup | 51/427 |
| 3,256,642 | 6/1966 | Fonti | 51/427 |
| 3,882,638 | 5/1975 | Black | 51/438 X |
| 3,994,097 | 11/1976 | Lamb | 51/436 X |
| 4,019,284 | 4/1977 | Hileman | 51/436 X |
| 4,048,757 | 9/1977 | Kubus . | |

*Primary Examiner*—Gary L. Smith

*Attorney, Agent, or Firm*—Fleit & Jacobson

[57] ABSTRACT

Apparatus for use in high pressure underwater abrasive-laden water jetting has a gun connected to a high pressure water pump and having an inductor connected to a source of abrasive. Abrasive is supplied to the inductor only when the gun is operated by reason of a control valve for an air supply to the abrasive container being opened to pressurize the container when water pressure is supplied, in other cases air continues to flow to prevent water entering the apparatus.

4 Claims, 1 Drawing Figure

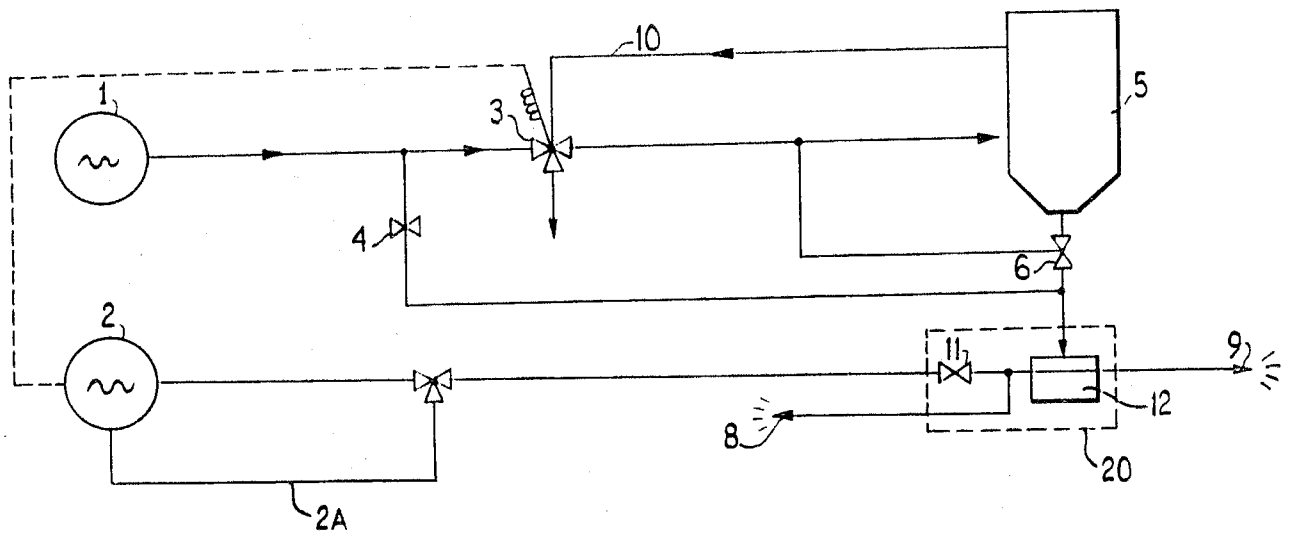
1
2
2A
3
4
5
6
8
9
10
11
12
20

UNDERWATER JET BLASTING APPARATUS

This invention relates to apparatus for performing underwater jetting operations.

High pressure water jetting is becoming the accepted method for the removal of marine growth and calligareous deposits from sea structures. Such growths and deposits can rapidly reach thicknesses of several inches, and attempts to remove them by scraping, air-guns and low pressure water jets have not proved as satisfactory as high pressure water jetting, in particular where abrasive is entrained in the water jet.

This invention concerns apparatus for high pressure underwater water jetting in which an abrasive such as sand is entrained in the jet.

For abrasive ladened high pressure water jetting on land, the apparatus required is a water pump driven for instance by a diesel engine, a supply or "pot" of sand or other abrasive, and a jetting gun including an inductor through which the water is passed so as to create a suction effect by which the abrasive is carried into the water, and an appropriate outlet nozzle selected according to the job in hand.

On land, of course, the supply of abrasive can be quite near to the inductor. Underwater, for instance when an off-shore installation is concerned, the operator with the gun may be hundreds of feet below the abrasive supply and the water pump. The abrasive can only be mixed with the water at the gun because otherwise it would cause undue wear on the connecting hose and it would be partially wasted because the underwater guns provide two jets, one for the abrading operation and the other in the reverse direction to act as a counter balance and to stabilize the operator. This means that the water and abrasive must be conducted separately to the gun, and this is done by the abrasive being entrained in air and carried thereby to the gun.

Consequential problems are that the supply of the abrasive must be stopped when the water jet is stopped by the operator. Nevertheless, when the abrasive supply is stopped the air flow should continue in order to prevent the abrasive supply tube becoming filled with water.

An aim of this invention is to provide apparatus which may conveniently provide these facilities.

According to the present invention there is provided apparatus for use in high pressure underwater abrasive laden water jetting, such apparatus including a gun to be connected to a high pressure water pump, the gun having a jetting nozzle and a water valve, a container for abrasive to be connected to an air pump to be pressurized thereby, an air line between the container and an abrasive inductor on the gun at which, in use, abrasive and air are mixed with water, an air by-pass to connect the air line with the air pump and an air control valve effective in use to direct air from the air pump to the container, and thus supply abrasive laden air to the inductor when the water valve is open, and effective to direct air from the air pump along the by-pass when the water valve is closed.

More particularly, the present invention provides apparatus for use in high pressure underwater abrasive laden water jetting, such apparatus including the high pressure water pump connected to a gun having a jetting nozzle and a water valve, an air pump, a container for abrasive which is pressurizable by the air pump and an air line between the container and an abrasive inductor on the gun at which in use abrasive and air are mixed with water, an air by-pass between the air pump and the air line and an air control valve effective to direct air from the air pump to the container, and thus supply abrasive laden air to the inductor, when the water valve is open and effective to direct air from the air pump along the by-pass when the water valve is closed.

The air control valve is preferably responsive to pressure at the water pump, which pump preferably has a by-pass facility so that prior to use of the apparatus the pump can be started and left running at zero pressure. Preferably also there is a valve in the air line between the container and the connection of the air line to the by-pass, which valve is arranged to open in response to air being passed to pressurize the container. Normally, the gun will have a balancing nozzle through which water but not in general abrasive is issued in the opposite direction to the jetting nozzle in order that the operator who may be many hundreds of feet below the water can be stabilized.

With the invention, because the air control valve is controlled by water pressure dependent upon whether or not the water valve is open, the abrasive will only be supplied when jetting operations are actually taking place. At other times, the abrasive container will not be pressurized, and a valve at its outlet will be closed but nevertheless air without abrasive will be supplied via the by-pass along the air line to the gun. At this time, the container will normally be vented.

The invention will be more clearly understood from the following description which is given by way of example only with reference to the accompanying schematic drawing illustrating apparatus according to the invention.

Shown in the drawing at 1 is an air pump, and at 2 a high pressure water pump having a by-pass line 2A. The water pump 2 can supply high pressure water to a gun schematically illustrated at 20 via a valve 11 on the gun and operable manually by the operator. In use water will pass from the valve 11 to an inductor 12 and then from there to a jetting nozzle 9. The gun has a balancing nozzle 8 in the opposite direction to the jetting nozzle 9 through which in use water will be jetted so as to balance the operator.

The air pump 1 can supply pressurizing air via a control valve 3 to an abrasive container or sand "pot" 5. Leading from the pot 5 to the inductor 12 on the gun is an air line in which there is an air controlled valve 6 which will be opened by the pressurised air when a water pressure controlled control valve 3 is opened to allow pressurized air to the container 5. At the inductor 12, air and abrasive from the air line are induced by suction into the water stream from pump 2. A by-pass line including a valve 4 inter-connects the air pump with the air line at a point downstream with valve 6. A vent line 10 from the container 5 is opened when the control valve 3 closes the supply of pressurized air to the container 5.

The water pressure controlled control valve 3 is controlled by the pressure of water at the water pump 2 so as to open to allow air to pass to container 5 and valve 6 when high pressure occurs upon opening of the water valve 11 at the gun.

In a practical embodiment, of course, the connections between the water pump and the gun and the abrasive container 5 and the gun may of course extend for several hundred feet depending upon the intended use.

In use, the first step will be for the container 5 to be filled with abrasive and for the air pump 1 to be started. At this time the valve 4 will be opened and the valve 3 closed so that air will pass down the air line to the inductor and out through the nozzle 9. The air pressure will not be so high that the gun will as a result be uncontrollable, and the gun is lowered to the operator or diver who will already have positioned himself in the region which is to be treated. At this time, the water pump 2 is started and placed on by-pass so that zero pressure is experienced and the control valve 3 is not actuated. Once the operator has recieved the gun, and arranged himself to use it, he will open the valve 11 with the result that the system is pressurized and high pressure water will be forced through the valve 11, through the inductor 12 where it will mix with air from the air line, and out through the nozzle 9. At the same time, water will emit from the balancing nozzle 8 so that the operator is not disturbed as to his position. As the water pressure at the pump 2 rises, the valve 3 is opened causing the container 5 to be pressurized and the valve 6 to open. At this stage, abrasive laden air will pass through the valve 6 to the inductor 12 to be intimately mixed with the water to be jetted through the nozzle 9.

Subsequently, when the operator closes the valve 11 the high pressure water system will be de-pressurized causing the control valve 3 to shut and the container 5 to be vented through the line 10. However, air from the pump 1 will continue to be supplied through the air line and the inductor 12 so that water will not syphon up the air line.

Valves 3 and 6 are preferably pressure control valves, operable respectively either directly by the water and air pressure or by an intermediate fluid medium if desired. In addition, valve 4 can if desired be similarly operated, to close when valve 3 opens and to open when it shuts.

Although the embodiment described above, and the invention as described hitherto, has contemplated the need for an operator to work underwater with the apparatus it is possible to operate the apparatus by remote control, employing actuating means for the gun and, if necessary, direction controlling means.

The inductor 12 preferably comprises a bored housing with a side inlet for pressurised fluid and an axial end inlet for the abrasive opening towards an outlet at the other axial end. The side inlet communicates with an annular chamber with jet openings leading from the chamber to the bore of the housing towards the outlet. Each jet opening is inclined to, as opposed being within, a radial plane passing through the axis of the housing, the inclination of the jets to such planes all being in the same sense.

I claim:

1. Apparatus for use in high pressure underwater abrasive-laden water jetting, such apparatus comprising in combination a gun; a jetting nozzle, an abrasive inductor, and a water valve in said gun; a high pressure water pump to which said gun is connected, said pump being pressurised on opening of said water valve; an air pump; a container for abrasive connected via an air control valve to said air pump to be pressurised thereby; an air line between said container and said abrasive inductor on said gun at which, in use, abrasive and air are mixed with water; an air by-pass to connect said air line with said air pump; means connecting said air control valve to said water pump whereby said air control valve is responsive to pressure conditions at said water pump to direct air from said air pump to said container, and thus to supply abrasive-laden air to said inductor, when said water valve is open and said water pump is pressurised; said air control valve being adapted to direct air from said air pump along the by-pass in response to the water valve being closed and said water pump being depressurised.

2. Apparatus as claimed in claim 1 including an air pressure controlled valve provided in the air line between the container and the connection of the air line to the by-pass, said air pressure controlled valve being connected to said air control valve to open in response to air being passed through said air control valve to pressurise said container.

3. Apparatus as claimed in claim 1, including in the water pump, a by-pass facility to permit starting of the pump and running at zero pressure prior to use.

4. Apparatus as claimed in claim 1 including, in the gun a balancing nozzle through which water, but not abrasive, is issued in the opposite direction to the jetting nozzle.

* * * * *